US006966854B1

(12) United States Patent
Gait

(10) Patent No.: US 6,966,854 B1
(45) Date of Patent: Nov. 22, 2005

(54) PRE-MANUFACTURED TRADITIONAL-STYLE LACROSSE POCKET

(75) Inventor: Paul Gait, Syracuse, NY (US)

(73) Assignee: J. deBeer & Son, Inc., Albany, NY (US)

( * ) Notice: Subject to any disclaimer, the term of this patent is extended or adjusted under 35 U.S.C. 154(b) by 34 days.

(21) Appl. No.: 10/338,632

(22) Filed: Jan. 8, 2003

Related U.S. Application Data

(60) Provisional application No. 60/347,061, filed on Jan. 8, 2002.

(51) Int. Cl.[7] ..... A63B 59/02; A63B 65/12
(52) U.S. Cl. ..... 473/513
(58) Field of Search ..... 473/512–514, 473/505, 543, 528, 553, 540, 521, 522, 534, 473/539, 557; D21/724; 84/306; 386/6; 383/16

(56) References Cited

U.S. PATENT DOCUMENTS

| | | | | |
|---|---|---|---|---|
| 733,542 A | * | 7/1903 | Converse | 383/16 |
| 891,813 A | | 6/1908 | Ceel | |
| 1,459,389 A | | 6/1923 | Brown | |
| 1,866,158 A | | 7/1932 | Goodwin | |
| 1,917,236 A | | 7/1933 | Bloomstrand | |
| 2,029,790 A | | 2/1936 | Philipp | |
| 2,039,138 A | | 4/1936 | Auer | |
| 2,075,372 A | | 3/1937 | Taylor | |
| 2,142,527 A | * | 1/1939 | Pool | 473/513 |
| 2,508,519 A | | 5/1950 | Jay | |
| 2,670,958 A | * | 3/1954 | Leiser et al. | 473/513 |
| 2,710,753 A | | 6/1955 | Lockwood | |
| D210,543 S | | 3/1968 | Nakayama | |
| 3,473,806 A | | 10/1969 | Patterson | |
| 3,507,495 A | | 4/1970 | Tucker | |
| 3,591,178 A | | 7/1971 | Milligan | |
| 3,702,702 A | | 11/1972 | Hoult | |

(Continued)

FOREIGN PATENT DOCUMENTS

| | | |
|---|---|---|
| CA | 342048 | 6/1934 |

(Continued)

*Primary Examiner*—Gregory Vidovich
*Assistant Examiner*—M. Chambers
(74) *Attorney, Agent, or Firm*—Waddey & Patterson, P.C.; Edward D. Lanquist, Jr.; Phillip E. Walker

(57) ABSTRACT

The present invention discloses a pre-manufactured or pre-formed pocket. The present pocket is secured using cross lace pieces and either runners or throat tie downs to be attached to the frame. Generally, the runners are made of a top runner piece and a bottom runner piece that are stitched together. In between the top runner piece and the bottom runner piece there are placed any number of cross pieces and cross lace pieces. The cross pieces maintain the maximum distance between the runners. The cross lace pieces are used to tie to secure the pocket to the frame. Either throat ties or the runners are then used to secure the bottom portion of the pockets to the throat of the frame. The top runner piece and the bottom runner piece can be secured together in any way including stitching or adhesive. Another embodiment creates a pocket from one or more sheets of material. A die or knife is used to cut the material into the desired shape. In that way a piece of material can be cut into a mesh pocket. The dimensions of the pocket, including the depth of the pocket can be adjusted by making the cuts bigger in the desired areas. Additionally, the die can have textures on the face to impart textures to the pocket thereby varying the surface roughness at different parts of the pocket.

7 Claims, 7 Drawing Sheets

U.S. PATENT DOCUMENTS 3,741,505 A * 6/1973 Engel ..... 244/145
3,822,062 A 7/1974 Tucker et al.
D236,737 S 9/1975 Brine
3,905,088 A 9/1975 Tucker
3,910,578 A 10/1975 Brine, Jr.
4,022,477 A 5/1977 Pool
4,034,984 A 7/1977 Crawford
4,037,841 A 7/1977 Lewis, Jr.
4,049,273 A * 9/1977 Pool ..... 473/513
4,097,046 A 6/1978 Friant
D248,679 S 7/1978 Rule
4,138,111 A 2/1979 Rule
4,153,251 A 5/1979 Pond
D252,167 S 6/1979 Ahlenfeld et al.
4,206,918 A 6/1980 Lewis, Jr.
4,270,756 A 6/1981 Ahlenfeld
4,270,768 A 6/1981 Ahienfeld et al.
D263,248 S 3/1982 Brine, Jr.
D263,249 S 3/1982 Rule
D265,845 S 8/1982 Brine, Jr. et al.
4,358,117 A 11/1982 Deutsch
D273,601 S 4/1984 Lewis, Jr. et al.
D277,691 S 2/1985 Rule
D286,803 S 11/1986 Brine, Jr.
D288,666 S 3/1987 Brun
4,657,260 A 4/1987 Brine, Jr.
4,739,994 A 4/1988 Lewis, Jr.
D297,963 S 10/1988 Tucker et al.
4,861,042 A 8/1989 Trettin
4,938,480 A 7/1990 Lods
4,940,243 A 7/1990 Tucker
D318,509 S 7/1991 Naumburg, Jr.
5,035,434 A 7/1991 Taylor
5,037,112 A 8/1991 Brine, III
5,048,843 A 9/1991 Dorfi et al.
5,087,726 A 11/1991 Brine, III
5,080,372 A 1/1992 Brine, III et al.
5,082,290 A 1/1992 Tucker et al.
5,178,397 A 1/1993 Brine, Jr.
5,269,532 A 12/1993 Tucker et al.
D350,173 S 8/1994 Tucker et al.
D350,174 S 8/1994 Tucker et al.
D350,999 S 9/1994 Chen
5,425,541 A 6/1995 Ambros
5,494,297 A 2/1996 MacNeil
5,566,947 A 10/1996 Tucker et al.
5,568,925 A 10/1996 Morrow et al.
D376,183 S 12/1996 Morrow et al.
5,651,549 A 7/1997 Dill et al.
5,651,744 A 7/1997 Millon et al.
5,674,140 A 10/1997 Tucker et al.
5,685,791 A 11/1997 Feeney
5,935,028 A 8/1999 Dill
5,938,550 A 8/1999 Hexemer et al.
5,957,791 A 9/1999 Nichols et al.
5,967,912 A 10/1999 Hexemer et al.
8,066,056 5/2000 Morrow
6,186,912 B1 2/2001 Gait
6,213,901 B1 4/2001 Collinson
D445,472 S 7/2001 Tucker
D844,834 7/2001 Tucker
6,283,879 B1 9/2001 Eden et al.
6,447,410 B2 * 9/2002 Crawford ..... 473/513
RE37,894 E 10/2002 MacNeil
6,500,079 B1 12/2002 Tucker, Sr.
6,506,132 B1 * 1/2003 Brine et al. ..... 473/513
6,520,875 B1 * 2/2003 Crawford ..... 473/513
6,533,688 B1 3/2003 Huang
6,561,932 B2 5/2003 Morrow et al.
RE38,216 E 8/2003 Morrow et al.
2001/0044347 A1 11/2001 Crawford
2002/0061374 A1 5/2002 O'Brien
2002/0107094 A1 8/2002 LeMire
2002/0160885 A1 10/2002 Brine, III
2002/0173388 A1 11/2002 Morrow
2004/0002398 A1 1/2004 Morrow

FOREIGN PATENT DOCUMENTS

CA 870192 5/1971
CA 880487 9/1971
CA 886691 3/1972
CA 803285 6/1972
CA 889892 5/1976
CA 1077989 5/1980
CA 1109091 9/1981
CA 1222853 6/1987
CA 1215406 12/1988
CA 1273662 9/1990
CA 1317610 5/1993
CA 2112721 7/1994
CA 2140080 2/1996
CA 2322830 9/1999
CA 2326206 5/2001
CA 2342273 9/2001
CA 2266981 1/2002
CA 2359858 4/2002

* cited by examiner

PRE-MANUFACTURED TRADITIONAL-STYLE LACROSSE POCKET

This utility application is claiming the benefit of provisional application Ser. No. 60/347,061 filed Jan. 8, 2002 and is a continuation of that application.

BACKGROUND OF THE INVENTION

The present invention relates generally to a sports implement and more specifically to a pre-manufactured or preformed pocket for a lacrosse stick that attaches to the frame to become a head.

The lacrosse game originated with the American and Canadian Native Americans. Traditionally, a lacrosse stick has a handle portion attached to a head. The head consists generally of a frame and a pocket. Traditionally, a pocket for a lacrosse head is hand stitched by the player using two or more strings with two or more runners. The runners and strings work together to form a pocket and are secured to the head frame using the combination of the runners and ties. Unfortunately, if one string breaks then the entire pocket will need to be replaced often times requiring that the other string be removed as well. Further, if one of the strings stretches or, more likely, if one of the runners stretches then many adjustments have to made to many portions of the pocket to tighten up the pocket to a predetermined depth and tightness.

There are currently at least three popular ways to construct lacrosse pockets:

1—Traditional: braided nylon or polyester lace woven between sidewall and longitudinal runners (sometimes referred to as thongs). The runners are traditionally leather or braided nylon and run between the scoop and inside throat area. The pocket is woven to the head as it is being created. Many traditional pockets comprise four runners, cross lacing, and side wall stringing. These materials are typically hand woven or strung in the traditional manner to form a pocket. The stringing and/or weaving of a traditional pocket is very labor intensive is typically done by hand.

Additionally, stringing a traditional pocket requires skill. Lacrosse players who do not have stringing skills are often required to hire independents that do. Alternatively, one can buy a head factory strung by the lacrosse manufacturer. If a lacrosse stick is purchased unstrung (without a pocket), then a stringing "kit" must be purchased. This kit includes material for weaving a traditional pocket.

Today, the traditional pocket is standard to the industry and is the most popular pocket among lacrosse players.

2—Mesh: machine woven nylon mesh is pre-manufactured and later attached to the sidewalls, scoop and inside throat areas. The mesh pockets consist of a polyester or nylon material woven together to create a diamond mesh (much like a mesh gymnastic bag). This mesh material is machine made and is the integral body of the pocket. A mesh material only allows for one consistent weave pattern.

3—Traditional/Mesh: a head that is strung with a combination of pre-manufactured mesh, hand woven lace and longitudinal runners.

Connected to the head is the handle. Lacrosse handles are extruded or formed in a single shape and diameter that runs over its length. They currently are made of alloy, titanium, wood or composite materials. The entire outer surface of each handle is made of all the same material.

The head of a lacrosse stick is commonly made of a moderately flexible plastic material. These heads may break due to weather conditions or a rough style of play. If a traditionally strung head breaks, the pocket cannot effectively be saved.

Additionally, lacrosse player's pocket may take months to "break in". During this period, the player becomes accustomed to the pocket and makes adjustments to make it personalized. The pocket is arguably the most crucial part of a lacrosse stick because it is the basis for good ball control, accurate passing, and fast, accurate shooting.

Accordingly, there is a need for replaceable preformed pocket netting that is easily replaceable, and requires a short "break in" period, but provides the performance characteristics demanded by lacrosse players.

The following U.S. patent generally describe the art of lacrosse sticks and heads, and are expressly incorporated herein by reference: U.S. Pat. Nos. 5,938,550; 6,066,056; 5,651,549; 5,568,925; 4,049,273; 5,425,541; 5,178,397; 5,048,843; 4,657,260; 4,270,756; and 4,138,111.

What is needed, then, is a pre-manufactured traditional pocket. This pre-manufactured pocket must be easy to manufacture. This needed pocket must be easy to attach to a frame to make a head. This needed pocket must be easily replaceable. This needed pocket must be available in many shapes. This needed pocket must be easy to adjust. This needed pocket is presently lacking in the prior art.

SUMMARY OF THE INVENTION

The present pockets are created using two methods. One is made of a solid piece of leather or synthetic material cut to form runners and cross pieces that make up the pocket. The pattern and number of cross pieces determine the pocket shape and depth when strung in the head. The other is created using braided nylon or polyester cross lace pieces and leather or synthetic runners to be attached to the frame. Generally, the runners are made of a top runner piece and a bottom runner piece that are stitched together. In between the top runner piece and the bottom runner piece there are placed any number of cross lace pieces. The cross pieces on both styles maintain the maximum distance between the runners. A braided nylon piece is then woven between the outside runners and the sidewall lace to secure the sides of the pocket. A piece of braided sidewall lace is used to secure the top end of the runners to the top scoop of the frame. The bottom end of the runners is then used to secure the throat portion of the pocket to the frame. The top runner piece and the bottom runner piece can be secured together in any way including stitching or adhesive. Another embodiment creates a pocket from one or more sheets of material. A die or knife is used to cut the material into the desired shape. In that way a piece of material can be cut to form a pocket. The dimensions of the pocket, including the depth of the pocket can be adjusted by making the cuts bigger or in different shapes in the desired areas. Additionally, the die can have textures on the face to impart textures to the pocket thereby varying the surface roughness at different parts of the pocket.

Accordingly, one object of the present invention is to provide a portion or an entire pre-manufactured pocket that does not have to be laced by hand.

Another object of the present invention is to provide a pocket that can be easily adjusted and replaced.

Another object of the present invention is to provide a pocket that is preformed so that the tightness and the depth of the pocket can be predetermined.

Another object of the present invention is to provide a pocket that can be easily manufactured.

Another object of the present invention is to provide a pocket that can be manufactured in different styles very easily.

Another object of the present invention is that by pre-manufacturing the pocket, the pocket can be easily replaced.

Another object is to provide a pocket that is not limited to the single weave pattern of mesh material, but instead can have a multitude of weave patterns again allowing in another way different pocket shapes.

Further, another object of the present invention is to allow manufactures to make unlimited pocket shapes predetermined by the manufacturer.

Another object is to provide a pre-manufactured pocket that consists of weather resistant material to prevent stretching when wet.

Still another advantage of the present invention is that the various pocket shapes can be created to have different throwing and ball retention properties.

Another advantage of the present invention is to provide a manually cut or die cut pocket made from one or more sheets of material.

Still another advantage of the present invention is to impart a surface texture to the pocket.

Yet another advantage of the present invention is to make the material cuts different sizes to allow the dimensions of the pocket to be varied.

DESCRIPTION OF THE PREFERRED EMBODIMENTS

Figure 6:
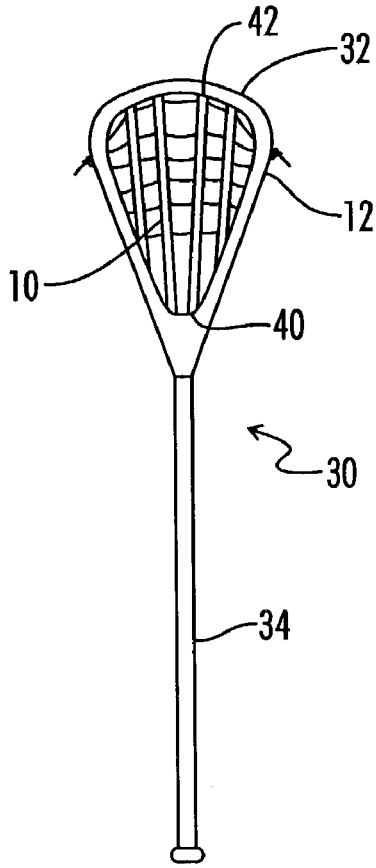
FIG. 6 is a plan showing the pocket attached to a lacrosse stick.

Referring now to FIG. 6 there is shown generally at 10 one embodiment of the lacrosse head pocket of the present invention. As can be seen from FIG. 6, lacrosse head pocket 10 is secured to frame 32 to create lacrosse head 12. In turn, lacrosse head 12 is secured to handle 34 to create lacrosse stick 30.

Figure 1:
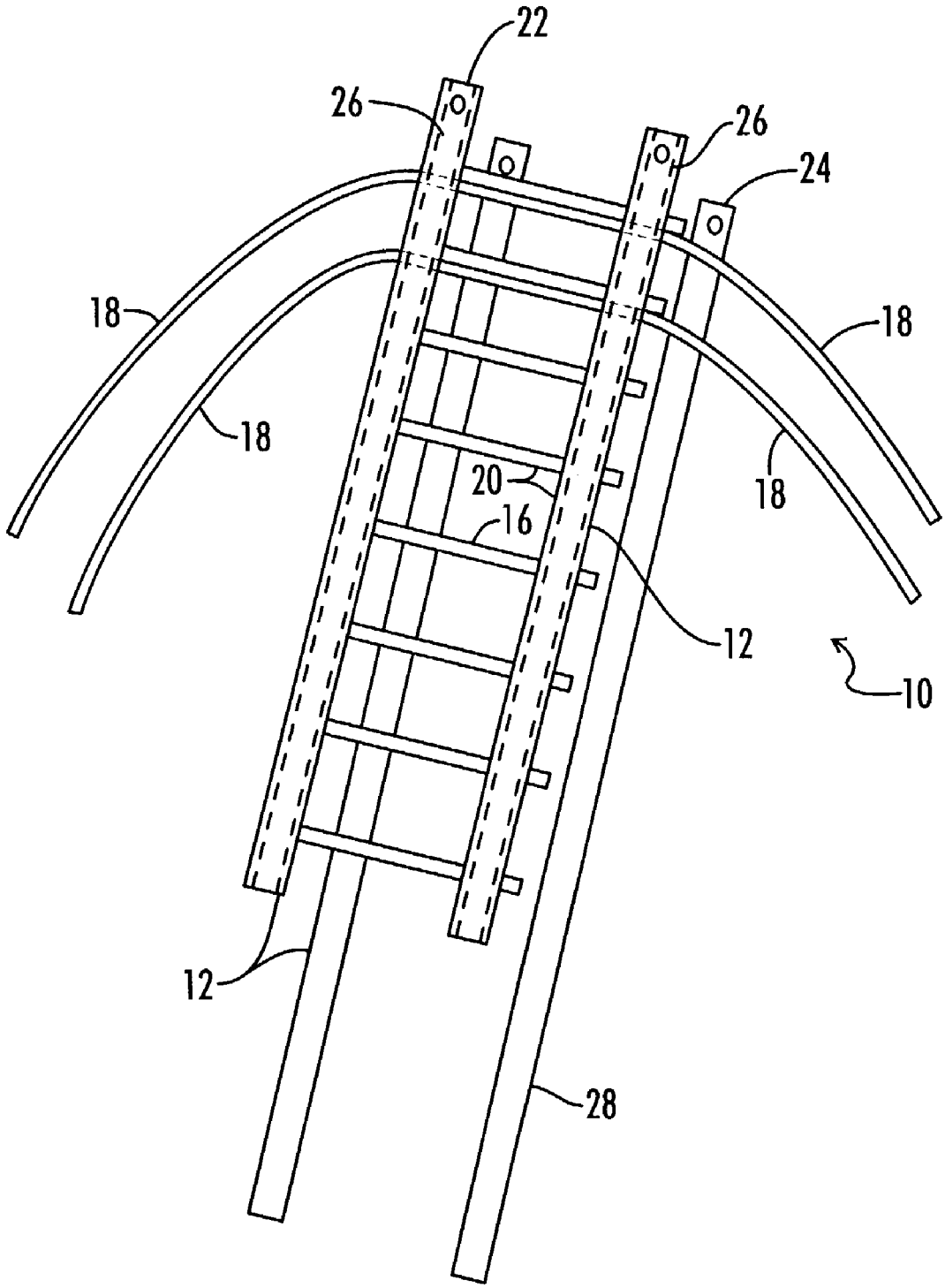
FIG. 1 is an exploded view of one embodiment of the pocket of the present invention.
Figure 2:
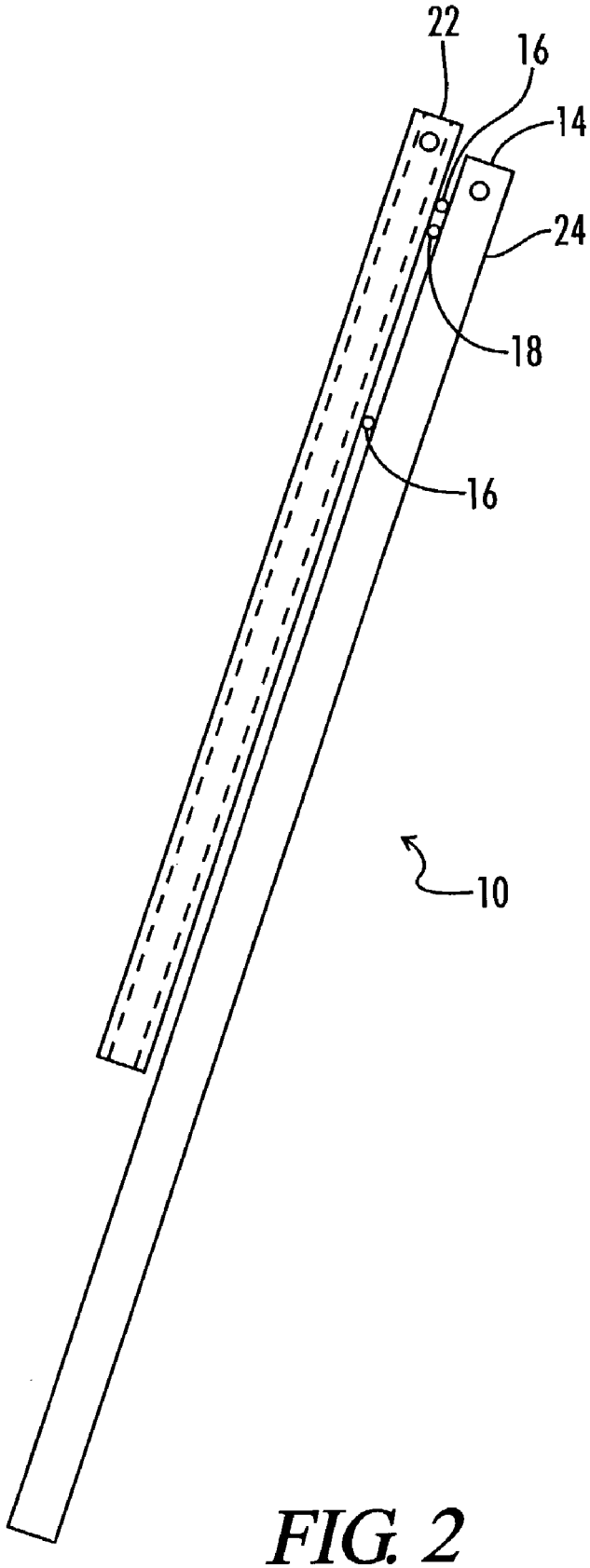
FIG. 2 is a side view showing the interaction between the top runner piece and the bottom runner piece.

Referring now to FIGS. 1 and 2, there is shown generally at 10 the lacrosse head pocket of the present invention. In a preferred embodiment, pocket 10 consists of at least one and preferably at least two runners 14 which are attached to one another at a predetermined distance by cross pieces 16. In the preferred embodiment, each runner 14 is made of a top runner piece 22 and a bottom runner piece 24 stitched together and sandwiching cross pieces 16. Additionally, cross lace pieces 18 can be sandwiched between top runner piece 22 and top runner piece 24 and attached to runners 14 to not only maintain a predetermined distance between runners 14 so that they can be easily attached to a frame of a lacrosse head. Therefore, it can be appreciated that cross pieces 16 are optional and can actually be entirely replaced by cross lace pieces 18. In a preferred embodiment both cross pieces 16 and cross lace pieces 18 are used. Cross pieces 16 or cross lace pieces 18 interact with runners 14 to create mesh 20. In a preferred embodiment, bottom runner piece 20 extends beyond top runner piece 22 to provide throat ties 28 to attach to the throat portion of the lacrosse head. However, just as easily, top runner piece 22 can be longer than bottom runner piece 24. Also, top runner piece 22 and bottom runner piece 24 can extend farther so that they both act as throat ties.

In a preferred embodiment, top runner piece 22 and bottom runner piece 24 are made of any type of suitable material including, without limitation, leather or synthetic leather. In the preferred embodiment synthetic leather such is of the type has a polyurethane substrate binding microfibers. However, a suitable type of heat pressed synthetic leather could also be used. In the preferred embodiment cross pieces 16 and cross lace pieces 18 are made of any suitable material. Preferably, cross pieces 16 and cross lace pieces 18 are made of a nylon or polyester twine. In the preferred embodiment, top runner piece 22 and bottom runner piece 24 are secured together using machine stitching 26. However, adhesives or heat sealing can also be used. In the preferred embodiment, top runner piece 22 is made of leather or synthetic material whereas bottom runner piece 24 is made of braided nylon or polyester.

Figure 3:
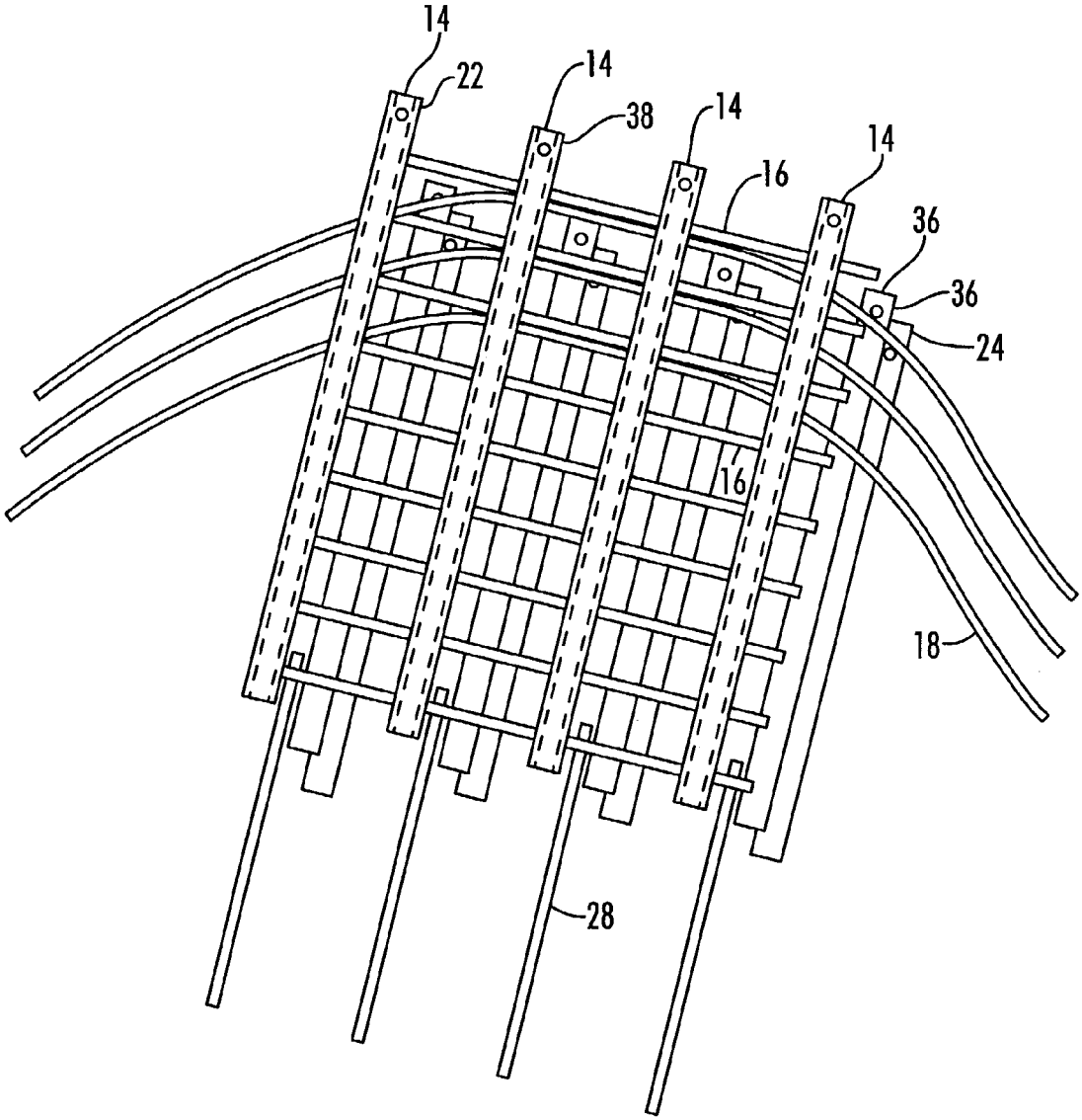
FIG. 3 is an exploded view of another embodiment of the present invention.

Referring now to FIG. 3 there is shown generally at 10 another embodiment of the lacrosse head pocket of the present invention. In this particular embodiment, instead of the two runners 14 shown in FIG. 1, four runners 14 are actually used. In the particular embodiment, in addition to top piece 22 and bottom piece 24, middle runner piece 36 is used. In the preferred embodiment, middle runner piece 36 is actually a nylon material. However, any material can be used. Likewise, instead of cross pieces 16 and cross lace pieces 18 merely securing two runners 14 together as shown in FIG. 1, four runners 14 are secured together using cross lace pieces 18 and/or cross pieces 16. Again, in the preferred embodiment, runners 14 are put together by stitching. Instead of one runner piece being longer than the others, in the embodiment of FIG. 3, throat ties 28 are actually pieces of material such as nylon or polyester which are actually attached in the sandwich formed by top runner piece 22, bottom runner 24, and middle runner piece 36. FIG. 3 also shows holes 38 that can receive other strings to more securely attach the pocket 10 to the frame.

Figure 4:
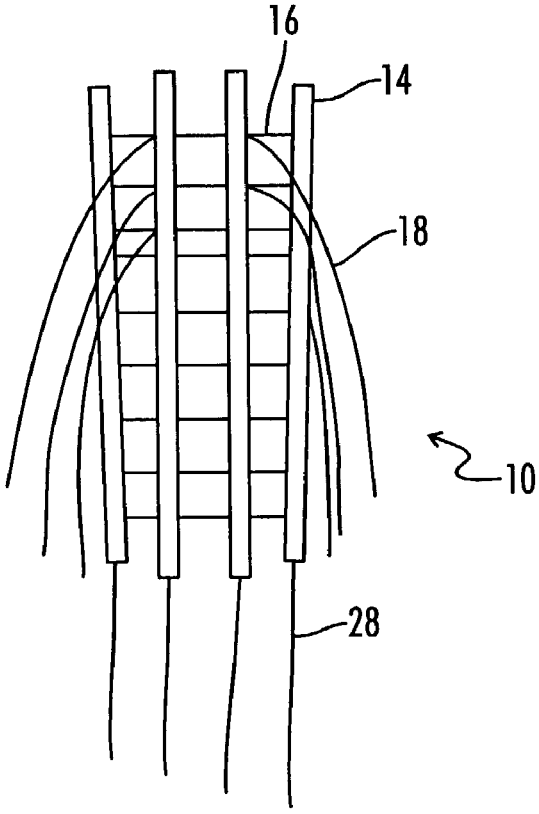
FIG. 4 is a plan view of the assembled pocket of one embodiment of the assembled pocket of the present invention.
Figure 5:
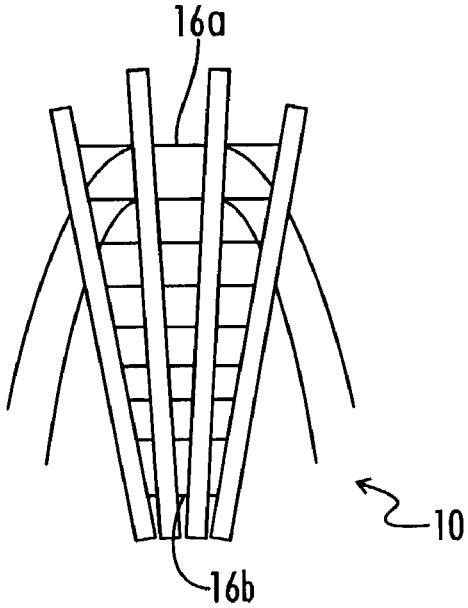
FIG. 5 is a plan view of another embodiment of the present invention.

Looking at FIGS. 4 and 5 together, there is shown some ways to make the lacrosse pocket 10 of the present invention. In FIG. 4, runners 14 are almost in parallel and held fairly equidistant apart by cross pieces 16 and/or cross lace pieces 18. Conversely, pocket 10 of FIG. 5 narrows as the bottom or throat portion of pocket 10 is approached. This is achieved by making cross pieces 16 be smaller at the end of throat portion of the pocket then opposite ends cross pieces 16*a*. Likewise, cross lace pieces 18 can be attached at different positions on runners 14 to effect the various distances between runners 14.

It can be further appreciated that by changing the lengths of cross pieces 16, distance between runners 14, and lengths of runners 14, differently shaped pockets can be achieved. For example, by varying the distance between runners 14 by securing the runners 14 on cross pieces 16 farther apart and making runners 14 longer, a deeper pocket 10 can be achieved. Further, by varying the distance in the same pocket 10, the depth of the pocket can be adjusted between throat 40 and scoop 42.

Figure 7:
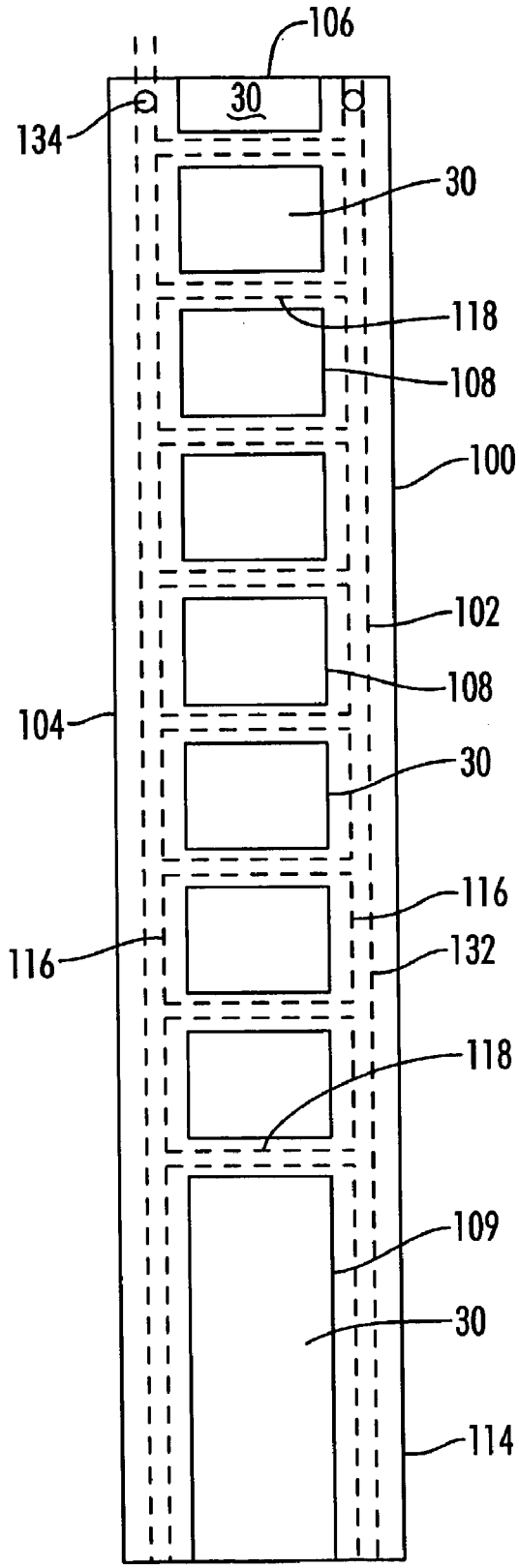
FIG. 7 is a plan view of one embodiment of the die cut pocket of the present invention.

Referring now to FIG. 7, there is shown generally at 100 the die cut or manually cut pocket of the present invention showing the cuts made in material 102. Material 102 has length 104 and width 106. Cuts 108 are made into material 102 preferably along length 104 but width 102 cuts may also be made. Texture can also be imparted to material 102 to have the texture of things such as leather or woven material. Cuts 108 can be made to different dimensions and shapes depending upon the desired shape and size of pocket 100. For example, to make pocket 100 deeper in the area of the throat (128 in FIG. 9), cuts 108 can be larger proximal to the throat. However, in the embodiment shown in FIG. 7, cutouts are square or rectangular in shape and the square cuts 108 are substantially the same size. However, cuts 108 can also be diamond shaped or any other desired shape. Cuts 109 area made to one end of material 102 to create throat ties 114. Preferably, at least two runners 116 and at least one cross piece 118 is created by cuts 108, 110. However, as many runners 116 and cross pieces 118 are provided as desired. In the embodiment shown in FIG. 7, support 132 is provided by either attaching it to a single layer of material 102 or sandwiching it between two pieces of material 102 either before or after material 102 has been cut. Mounting holes 134 can also be cut into material 102.

Figure 8:
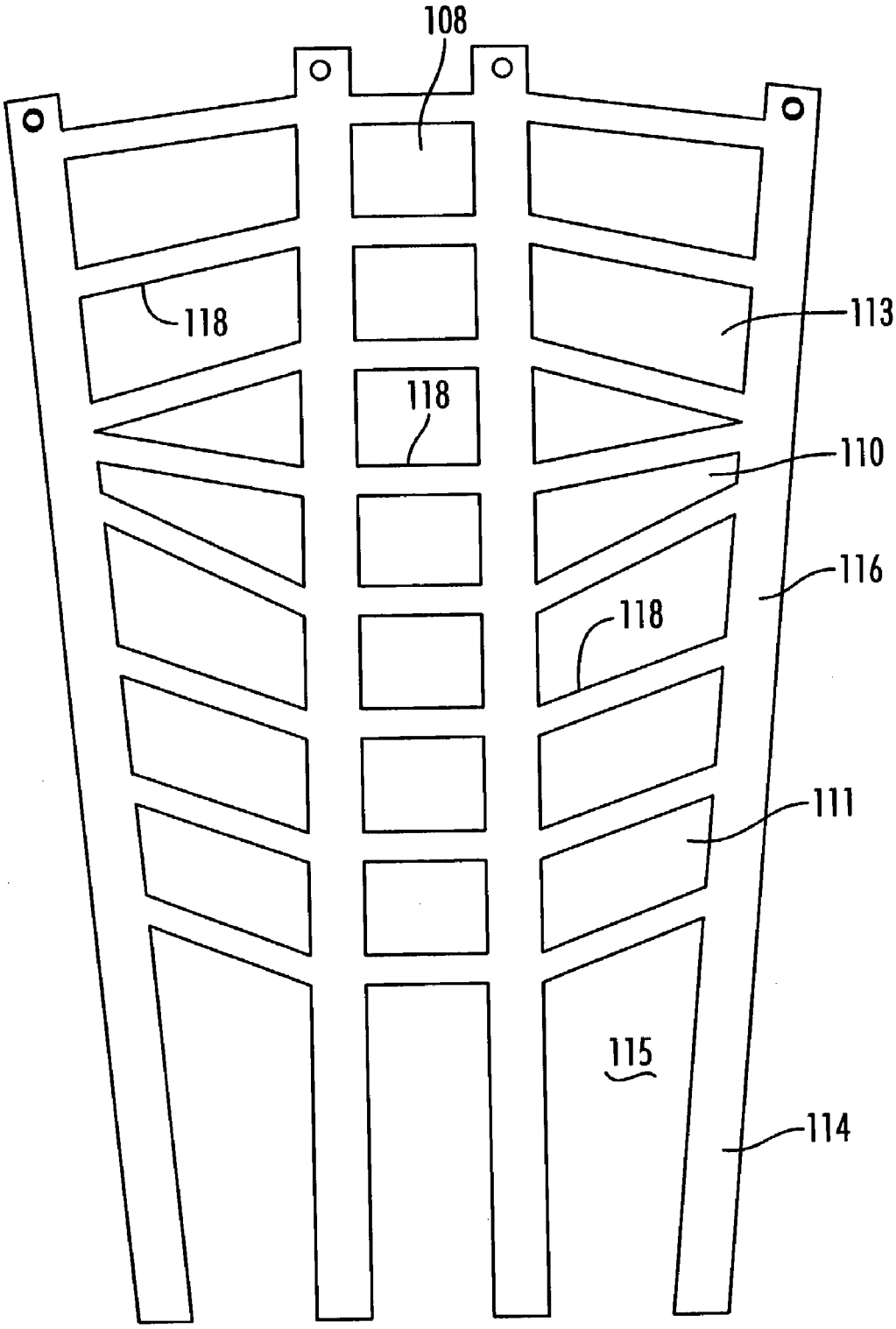
FIGS. 8 and 9 are views of another embodiment of the die cut pocket of the present invention.
Figure 9:
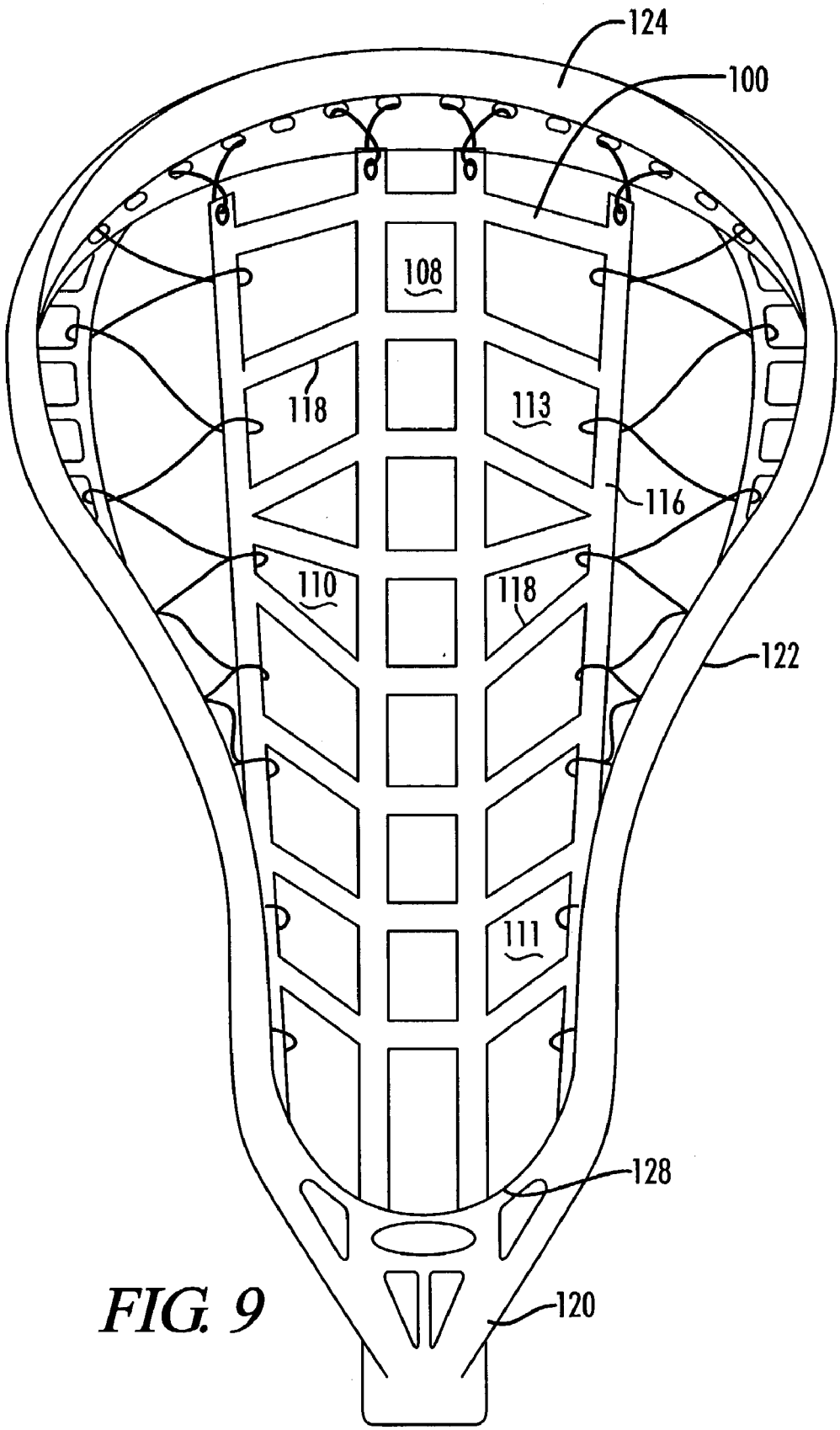

Referring now to FIGS. 8 and 9, there is shown generally at 10 another embodiment of pocket 100 of the present invention by itself and strung on frame 122 of head 120. By changing the size and shape of cuts 108, 110, 111, 113, the depth of pocket 100 can be varied between scoop 124 and throat 128 with many players wanting a deep pocket proximal to throat 128 or to scoop 124. Therefore, by making cuts such that cross pieces proximal to scoop 124 are longer than proximal to throat, and by mounting pocket 100 to frame 122 so that runners 116 are substantially parallel, pocket 100 is deeper proximal scoop 124. Texture 112 can be provided to simulate woven material or leather. Cuts 108 are preferably square. Cuts 110 are substantially triangular. Cuts 111 and 113 are preferably rhomboid. Cuts 115 to make throat ties 114 can also be varied in shape and size.

Preferably, dies is a ruler die or stamp. The die can both cut and place texture on the material. However, a roller die can also be used. The material can be leather, synthetic leather, woven cloth or any other material. Additional strength can be added by using multiple layers to create material 102.

Thus, although there have been described particular embodiments of the present invention of a new and useful Pre-manufactured Traditional-Style Lacrosse Pocket, it is not intended that such references be construed as limitations upon the scope of this invention except as set forth in the following claims.

What is claimed is:

1. A lacrosse pocket comprising:

at least two runners, each of the runners having a top runner piece attached to a bottom runner piece;

a first cross piece and a second cross piece both attached to the runners between the top runner piece and the bottom runner piece joined substantially perpendicularly to the runners;

wherein the runners and cross pieces are positioned to form a lacrosse pocket; and wherein the distance between the runners along the first cross piece is longer that the distance between the runners along the second cross piece.

2. The pocket of claim 1 wherein the top runner piece and the bottom runner piece are stitched together.

3. The pocket of claim 1 wherein the bottom runner is longer than the top runner.

4. The pocket of claim 1 wherein the top runner is longer that the bottom runner.

5. The pocket of claim 1 further comprising a throat tie attached to one end of the runners between the top runner piece and the bottom runner piece.

6. The pocket of claim 1 wherein the runners are made from a material selected from the group consisting of leather and synthetic leather.

7. The pocket of claim 1 wherein the cross lace pieces are made from a material selected from the group consisting of nylon and polyester.

* * * * *